United States Patent [19]

Ubezio

[11] 4,327,499

[45] May 4, 1982

[54] DRAFTING APPARATUS

[75] Inventor: Lorenzo Ubezio, Dietikon, Switzerland

[73] Assignee: Reppisch-Werke AG, Dietikon, Switzerland

[21] Appl. No.: 133,603

[22] Filed: Mar. 24, 1980

[30] Foreign Application Priority Data

Apr. 3, 1979 [CH] Switzerland ..... 3075/79

[51] Int. Cl.[3] ..... B43L 13/02

[52] U.S. Cl. ..... 33/438; 33/DIG. 1; 33/468

[58] Field of Search ..... 33/430, 438, 434, 437, 33/448, 468, 469, 470, 471, DIG. 1

[56] References Cited

U.S. PATENT DOCUMENTS

| | | | |
|---|---|---|---|
| 842,585 | 1/1907 | Ross | 33/469 |
| 2,568,575 | 9/1951 | Wickman | 33/DIG. 1 |
| 2,627,323 | 2/1953 | Larson | 33/437 X |
| 2,836,892 | 6/1958 | Nisenson | 33/403 X |
| 3,137,072 | 6/1964 | Terry | 33/437 |

FOREIGN PATENT DOCUMENTS

| | | | |
|---|---|---|---|
| 522081 | 8/1953 | Belgium | 33/437 |
| 377676 | 7/1907 | France | 33/438 |
| 1206363 | 8/1959 | France | 33/DIG. 1 |
| 8354 | of 1909 | United Kingdom | 33/474 |

*Primary Examiner*—Harry N. Haroian

*Attorney, Agent, or Firm*—W. G. Fasse; D. F. Gould

[57] ABSTRACT

The present drafting apparatus comprises a drafting board (1) having secured to one longitudinal edge thereof a metal rail (4). A runner (3) and a rail (2) are displaceable along the metal rail (4). The runner (3) is pulled against the metal rail (4) by magnets. A carriage (6) supporting a ruler (5) having about a square shape, is displaced along the rail (2) and held in place by magnets (43) cooperating with the rail (2) at least the edges of which are made of ferromagnetic material. In order to adjust the rail (2) through relatively small horizontal or vertical angles, the rail (2) is tiltably secured to the runner (3) for adjustment through angles of about 10° to 20°, preferably 15° in either direction from the perpendicular position relative to the runner. The tilting movement is transmitted to the rail with the aid of a rod (19) spaced from the journal stud (12) and with the aid of a slide (21) which may be arrested relative to the rail (2).

16 Claims, 11 Drawing Figures

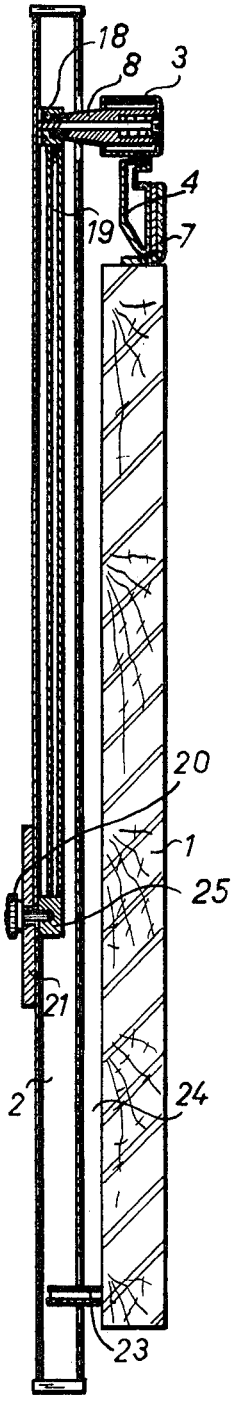
Fig. 3
Fig. 5
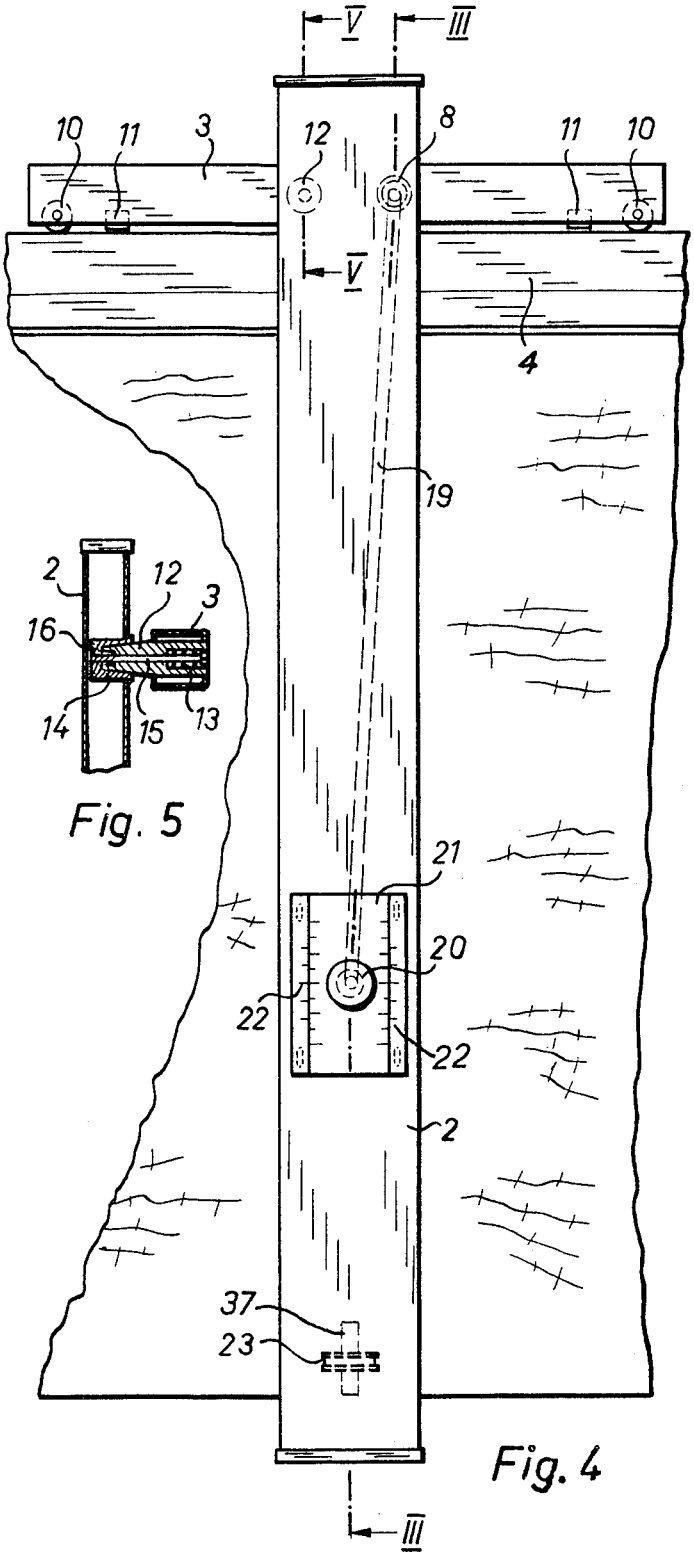
Fig. 4

DRAFTING APPARATUS

BACKGROUND OF THE INVENTION

The present invention relates to a drafting apparatus which may be secured to a drafting or drawing board. The apparatus includes a horizontally shiftable or adjustable rail and a ruler extending substantially perpendicularly to the rail.

Drafting devices in which so-called T-square rails are position adjustable have been known for years. Such T-square rails are displaceable along an edge of the drafting board. However, the use of such T-squares is limited to drafting equipment in which the drafting board is maintained practically in a horizontal position.

On the other hand, so-called drafting heads are known which carry a ruler and which in turn are movable by means of a rod arrangement forming a parallelogram. Such devices require a high precision and as a result they are relatively expensive.

Additionally, the rod arrangement forming a parallelogram requires a counterweight which in turn makes the entire structure relatively heavy.

OBJECTS OF THE INVENTION

In view of the above it is the aim of the invention to achieve the following objects singly or in combination:

- to provide a drafting apparatus which is relatively simple and hence may be economically manufactured;
- to provide the practical benefits of a T-square for executing highly accurate drafting work on a drafting board which may take up substantially any desired position between the horizontal position and the vertical position;
- to combine a ruler with a T-square which simultaneously permits to draw angular lines or which carries a plurality of drafting symbols for convenient use;
- to provide a T-square which is adjustable within a certain angular range relative to the normal, rectangular position of the T-square relative to an edge of the drafting board;
- to provide a ruler which may be used separately, that is, without the T-square, or which may be easily combined with the T-square; and
- to combine the ruler with a carriage so that the ruler may be moved along the T-square to any desired position.

SUMMARY OF THE INVENTION

According to the invention there is provided a drafting apparatus which may be secured to a drafting board and including a T-square rail which may be adjusted in a direction across the board, that is, in a horizontal direction regardless whether the board takes up a horizontal position or a vertical position or any position therebetween. A ruler is adjustable along the T-square rail. In other words, the ruler runs in parallel to the longitudinal axis of the T-square rail. The ruler may attach to either side of the T-square rail. The T-square rail is secured to a runner by adjustment means so that the T-square rail is tiltable and arrestable relative to its displacement direction. The ruler is secured to a support carriage which in turn is adjustably held to a narrow edge of the T-square rail by magnetic force, whereby the carriage and thus the ruler may be displaced into any desired position along the length of the T-square rail and whereby the carriage with the ruler may be removed from the T-square rail.

The just described structure may be manufactured by relatively simple means, yet it makes possible the execution of precision drafting work. Additionally it is possible to easily remove the ruler from the T-square rail and use the ruler separately.

BRIEF FIGURE DESCRIPTION

In order that the invention may be clearly understood, it will now be described, by way of example, with reference to the accompanying drawings, wherein:

FIG. 3 is a sectional view along section line III—III in FIG. 4;

FIG. 4 is a top plan view onto the T-square on an enlarged scale as compared to the illustration of FIG. 1;

FIG. 5 is a sectional view along section line V—V in FIG. 4;

DETAILED DESCRIPTION OF PREFERRED EXAMPLE EMBODIMENTS AND OF THE BEST MODE OF THE INVENTION

Figure 1:
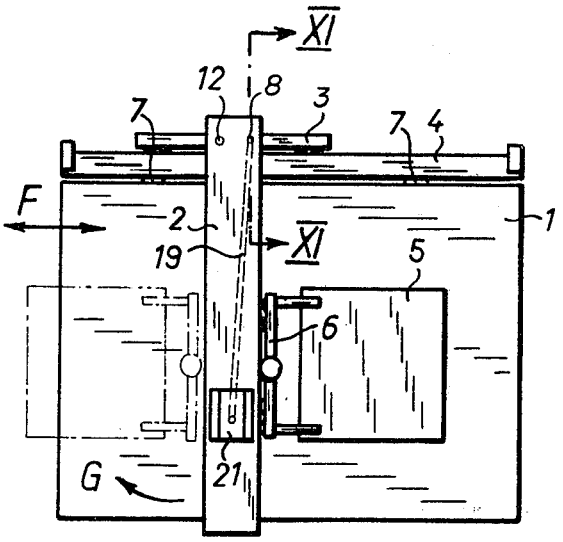
FIG. 1 is a top plan view of the drafting apparatus according to the invention, wherein the T-square rail extends perpendicularly to its displacement or adjustment direction, such adjustment direction extending horizontally across the drafting board and in parallel to the longer edges of the drafting board.
Figure 2:
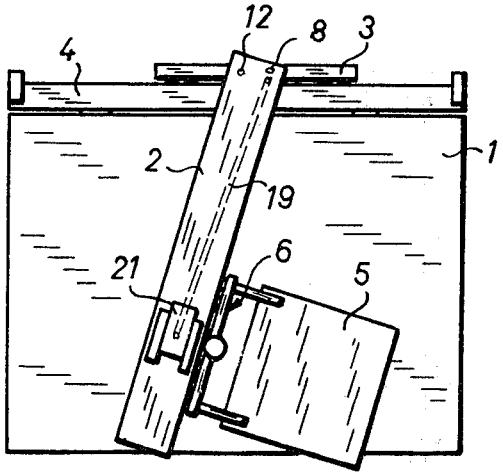
FIG. 2 is a view similar to that of FIG. 1, however showing the T-square rail in an angularly adjusted position relative to the position shown in FIG. 1.
Figure 6:
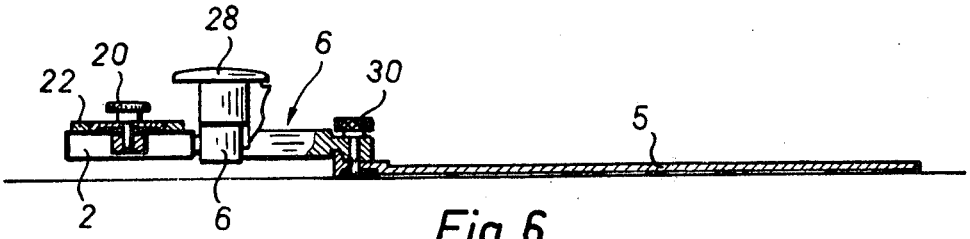
FIG. 6 is a sectional view along line VI—VI in FIG. 7.

The drafting apparatus according to FIGS. 1 and 2 comprises a conventional drafting board, for example made of wood or the like. A T-square rail 2 is adjustable across the board in the directions indicated by the double arrow F. For this purpose the T-square 2 has a headpiece or runner 3 constructed to run along a guide rail 4 secured to one longitudinal edge of the board 1. The basic construction of the T-square with its rail 2 and runner 3 corresponds substantially to that of conventional T-squares as they are used in connection with simple drafting boards. However, contrary to conventional T-squares, the rail 2 according to the invention is tiltable relative to the headpiece or runner 3 through an angle range of about 15° in the direction indicated by the arrow G. This adjustment is accomplished about a journal stud 12 rigidly secured to the headpiece or runner 3.

The headpiece or runner 3 is equipped with at least two permanent magnets 11 as shown in FIG. 4 which are positioned opposite the guide rail 4 secured to a narrow edge of the drafting board 2. The guide rail 4 is made of ferromagnetic metal so that the headpiece or runner 3 is pulled toward the guide rail 4 by the force of the magnets 11. These magnets 11 are kept at a defined small spacing from the guide rail 4. For example, such spacing may correspond to 2/10 of a millimeter. Rollers 10, shown in FIG. 4 next to the magnets 11, rest against the guide rail 4 and are rotatably supported in the headpiece or runner 3, whereby the latter may be easily displaced along the guide rail 4. The guide rail 4 is secured to the board 1 by two brackets 7 shown in FIGS. 1 and 3. The brackets may be screwed to the board or otherwise secured thereto by conventional means.

As shown in FIG. 2, the rail 2 may, if desired, be tilted through an angle of about 15° relative to the position shown in FIG. 1. This tilting movement, or rather the tilted position may be arrested by means of a rod 19 and an arrestable slider 21 on the rail 2. The rail 2 is adjustable because in this manner it is possible by simple means to draw lines which are inclined by an angle of a few degrees if that should be required. The adjustment is possible in either direction. The runner 3 is connected to the rail 2 by adjustable connecting means as follows.

Figure 11:
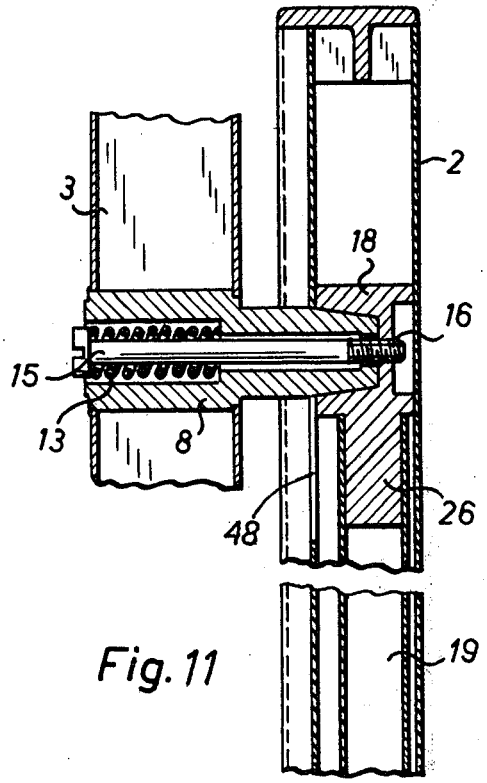
FIG. 11 is a sectional view along line XI—XI in FIG. 1.

Two journal studs 8 and 12 rigidly secured to the runner or headpiece 3 extend away from the latter. The journal studs 8 and 12 have a conical shape toward their outer ends for cooperation with a bearing member 14, 18 having a conical bore in which the respective journal stud 8 and 12 is received. The bearing members 14 and 18 are supported in the rail 2. Each journal stud 8, 12 is provided with an axial bore through which a screw 15 extends as best seen in FIG. 11. A helical spring 13 bears against the screw head. The screw 15 engages with its thread end into a threading 16 of the respective bearing member 14, 18 in such a manner that the journal stud 8, 12 is drawn or rather pushed into the respective female conical bore in the bearing member 14, 18. This just described structure provides frictional connections between the male and female conical surfaces which are practically free of play, but which permit a tilting movement of the rail 2 relative to the runner 3. The stud 12 and the bearing member 14 constitute first journal means about which the rail 2 is tiltable clockwise or counterclockwise. The stud 8 and the bearing member 18 constitute second journal means about which said rod 19 is tiltable with the tilting of the rail 2, whereby a slot 48 in the rail 2 moves relative to the stud 8 as shown in FIG. 11.

The just described connecting means between the rail 2 and the runner 3 are horizontally spaced from each other. The journal studs 8 and 12 and the respective female bearing member 14, 18 and the screw 15 as well as the spring 13 are substantially the same in each connecting structure except that the female bearing member 18 which cooperates with the journal stud 8 is provided with a cylindrical projection 26 to which one end of the above mentioned rod 19 is rigidly connected. Additionally, the female bearing member 18 is adjustably held in a longitudinal slot 48 of the rail 2. Instead of the threaded connection 16 it would be possible to use a so-called bayonet catch.

The other end of the rod 19 is connected to a slider 21 which is guided between parallel guide rails 22 as best seen in FIG. 4. The slider 21 as well as the guide rails 22 may be provided with scales for precisely adjusting the relative displacement between the slider 21 and the guide rails 22. The rod 19, which may be a tubular member as shown in FIG. 3, is connected to a bearing element 25 which in turn is connected to the slider 21 through an adjustable screw 20 having, for example, a knurled head. With the aid of this screw 20 the bearing element 25 may be fixed in a desired position so that the relative displacement between the rail 2 and the runner 3 may be fixed by tightening the head screw 20. The above mentioned scales on the slider 21 and on the guide rails 22 are so calibrated that the angular position of the rail 2 relative to the runner 3 may be directly read as an angular value on these scales.

As best seen in FIGS. 3 and 4, a roller 23 is operatively secured to the free end, which is the lower end in the illustration, of the rail 2. The rotational axis 37, shown in dashed lines in FIG. 4, of the roller 23 extends in parallel to the longitudinal axis of the rail 2. Thus, the rail 2 does not rest directly upon the drafting board but an intermediate space 24 is provided between the rail 2 and the top surface of the board 1 located below the rail.

Figure 7:
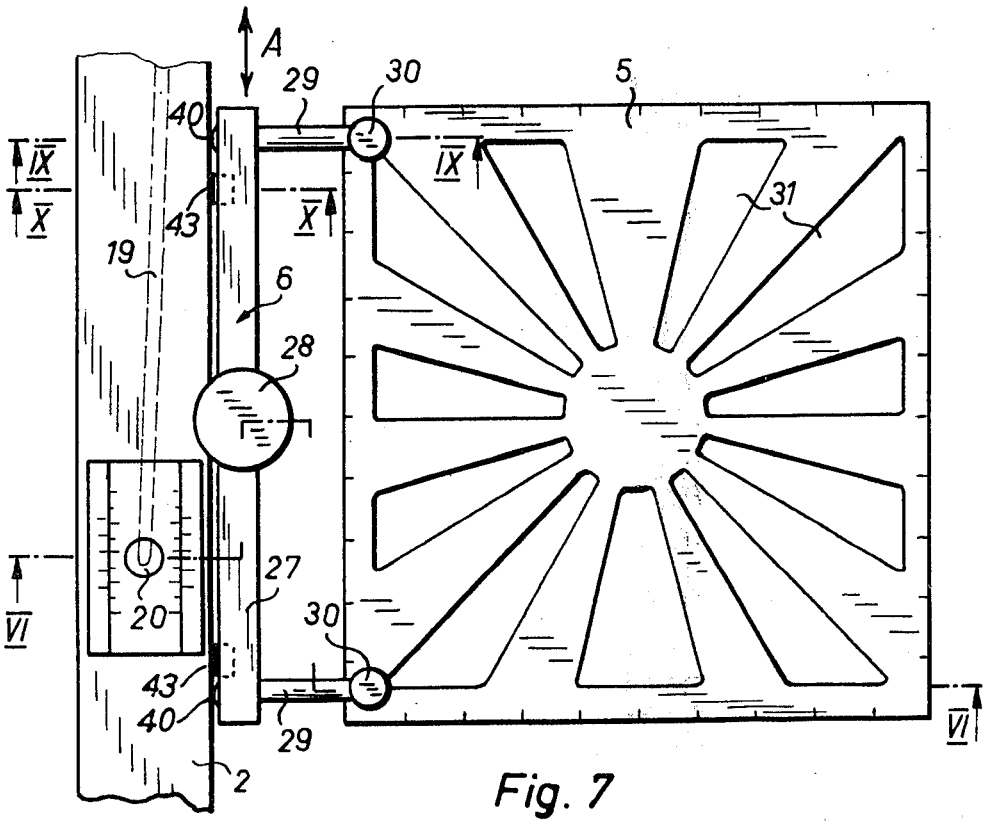
FIG. 7 is a top plan view onto the carriage and ruler on an enlarged scale relative to the illustration of FIG. 1.

The rail 2 is made of ferromagnetic metal. A carriage 6 is displaceable along one or the other of the narrow edges of the rail 2 as shown in FIG. 1. The carriage 6 is provided with rollers 40 which bear against the narrow edge 47 of the rail 2 due to the force of permanent magnets 43 as will be disclosed in more detail below. The carriage 6 supports a ruler 5 which may, for example, have a substantially square shape and which may be provided with different types of scales along its edges. Additionally, the inner surface of the ruler 5 may be provided with different types of cutouts 31 for drawing angular lines or these cutouts may comprise drafting symbols. The carriage 6 and with it the ruler 5 may be easily removed from the rail 2 once the force of the magnets 43 is overcome. The cutouts 31 shown in FIG. 7 are not shown in FIGS. 1 and 2 for simplicity's sake.

Figure 8:
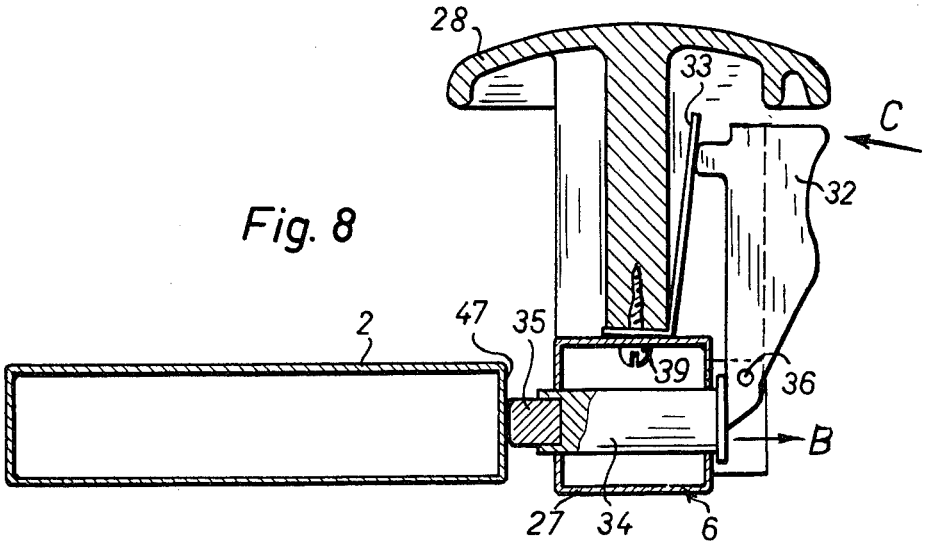
FIG. 8 is a sectional view through a handle forming part of the ruler carriage and including brake means for locating the ruler carriage and with it the ruler in any desired position.
Figure 9:
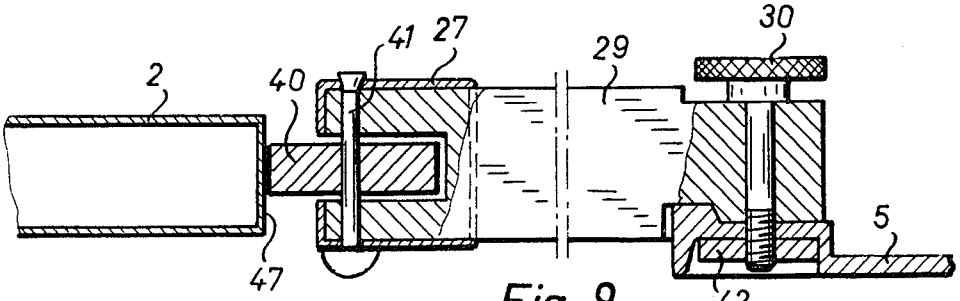
FIG. 9 is a sectional view along line IX—IX in FIG. 7.
Figure 10:
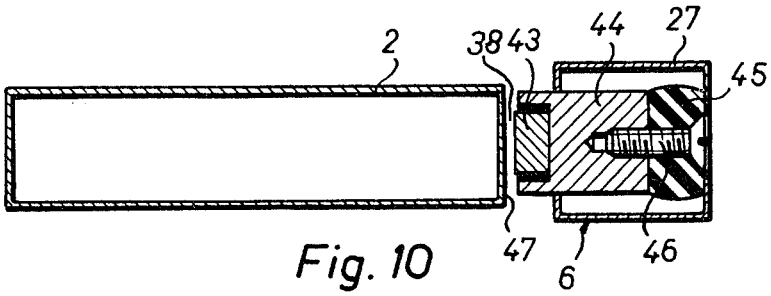
FIG. 10 is a sectional view along line X—X in FIG. 7.

The details of the carriage 6 carrying the ruler 5 are shown in FIGS. 6 to 10. The carriage 6 comprises a metallic molding 27, for example, having the shape of a four-cornered pipe section extending in parallel to the rail 2 and carrying at least two of the above mentioned permanent magnets 43. The magnets 43 are located so that they face the narrow edge 47 of the rail 2. Each magnet 43 is held by a respective magnet yoke 44 inside the tubular molding 27 as shown in FIG. 10. The yokes 44, and with the yokes the respective magnets 43 are adjustable in their position relative to the narrow edge 47 by means of a screw 46 and a rubber buffer 45. The screw 46 is accessible through molding 47 forming the carriage 6 whereby the air gap 38 may be adjusted. Rollers 40 of which at least two are operatively supported in the tubular molding 27, are rotatable about a respective axis 41. The rollers 40 are so positioned that the air gap 38 may be adjusted, for example, within a range of 1/10 to 2/10 of a millimeter.

The ruler 5 is connected to the carriage 6 by two brackets 29 preferably made of synthetic material and attached to the carriage 6 by means of headed screws 30 so that the ruler 5 may be easily exchanged against another ruler, for example with different cutouts 31. The screws 30 clamp the ruler 5 against the bracket 29 with the aid of nuts 42 as best seen in FIG. 9. Thus, the carriage 6, including the ruler 5 is easily adjustable along the rail 2 in the direction of the double arrow A as shown in FIG. 7 without any need for loosening any screw connection.

The metallic molding 27 may, for example, be a four cornered pipe thereby forming an elongated carriage member. A handle 28 best seen in FIG. 8 is secured to the elongated carriage member 27. The handle 28 is so arranged relative to a brake mechanism that by holding the handle with one hand the brake lever 32 may be actuated by the thumb. The brake lever 32 is journaled by means of a journal pin 36 and cooperates with its lower end with a bolt 34 operatively supported in the carriage member 27. The bolt 34 carries a brake shoe 35 at its end facing the narrow edge 47 of the rail 2. The brake shoe 35 is made of a high friction material. Screw means 39 secure the handle 28 and a leaf spring 33 to the carriage member 27. The upper free end of the leaf spring 33 bears against a boss of the brake lever 32 so that normally the brake shoe 35 engages the narrow edge 47 of the rail 2, whereby the position of the carriage 6 and thus of the ruler 5 relative to the drafting board 1 is secured. The force of the spring 33 and thus the brake force of the brake shoe 35 is smaller than the force of the magnets 43 effective in the opposite direction. However, the friction caused by the brake shoe 35 is sufficient to prevent that the carriage 6 will fall off the rail 2 when the drafting board 1 is in a vertical position. Thus, the carriage 6 remains in the intended position at all times except when the brake lever 32 is pressed in the direction of the arrow C for adjusting the position of the carriage 6 along the rail 2. During this adjustment only the magnetic force is effective because the bolt 34 is moved in the direction of the arrow B, thereby lifting the brake shoe 35 off the narrow edge 47 of the rail 2, whereby the adjustment is easily accomplished.

Preferably, the ruler has a substantially square shape and is provided with a plurality of cutouts 31, the bounding edges of which are spaced by 15° each, whereby the edges extend substantially radially outwardly from the center of the ruler. Thus, it is possible to draw lines which are displaced by 15° or any other angle depending on the radial displacement of the boundary lines of the cutouts 31. This is possible without shifting the rail 2 into another position. However, if angles of less than 15° are to be drawn this may be accomplish by adjusting the rail 2 into a slanted position as shown in FIG. 2. Thus, it is possible, according to the invention to draw lines having any desired angular disposition. Instead of or additionally to the shown cutouts the ruler may be provided with any number of suitable drafting symbols.

If both narrow edges of the rail 2 are made of ferromagnetic material, or if the entire rail 2 is made of ferromagnetic material, the carriage 6 may be positioned on either side of the rail 2 as shown in FIG. 1 in full lines as well as in dash-dotted lines.

Incidentally, the angular adjustment shown in FIG. 2 is possible because of the longitudinal slot 48 in the rail 2 shown in FIG. 11 by means of which the rail 2 may move relative to the journal stud 8 clockwise or counter-clockwise. In the vertical position of the rail 2 shown in FIG. 1 the stud 8 would be located about centrally in the slot 48. When the rail 2 is tilted about the first journal means 12, 14 in one or the other direction, the slot in the rail 2 will move relative to the stud 8 whereby rail 2 is adjusted into an angular position as shown in FIG. 2.

Although the invention has been described with reference to specific example embodiments, it will be appreciated, that it is intended to cover all modifications and equivalents within the scope of the appended claims.

What is claimed is:

1. A drafting apparatus for cooperation with a drafting board, comprising rail means, runner means (3), adjustable connecting means operatively securing said runner means to said rail means (2) for displacing said rail means relative to a drafting board, whereby said rail means are displaceable and adjustable into an angular position relative to a centered position in which the rail means extend perpendicularly to an edge of a drafting board, arresting means (20) cooperating with said connecting means for holding said rail means in a fixed adjusted position, said apparatus further comprising carriage means (6), magnetic means forming part of said carriage means and part of said rail means, whereby said carriage means is adjustably secured to said rail means by said magnetic means, ruler means (5) operatively secured to said carriage means (6) so that the position of said ruler means is adjustable by moving said carriage means along said rail means, and wherein said adjustable connecting means comprise first journal means (12, 14) operatively securing said runner means (3) to said rail means (2) for tilting said rail means (2) relative to said runner means (3), said connecting means further comprising a rod (19), slide means (21, 22) operatively securing one end of said rod (19) to said rail means (2), and second journal means (8, 18) for tiltably securing the other end of said rod to said runner means.

2. The apparatus of claim 1, wherein said magnetic means comprise permanent magnets operatively secured to said carriage means and ferromagnetic means forming part of said rail means for cooperation with said permanent magnets.

3. The apparatus of claim 2, wherein said rail means comprise two narrow edges, at least said narrow edges of said rail means being made of ferromagnetic material whereby said carriage means may be adjusted along either one of said narrow edges.

4. The apparatus of claim 1, further comprising a drafting board having at least one edge made of ferromagnetic material, and wherein said adjustable connecting means operatively securing said rail means (2) to said runner means (3) comprise further magnetic means forming part of said runner means, said further magnetic means cooperating with said at least one edge of said drafting board, whereby said runner means are adjustably secured to said drafting board, and roller means operatively interposed between said runner means and said one edge of said drafting board, whereby said runner means are adjustable into any desired position along said one edge of said drafting board and held in said adjusted position by said further magnetic means.

5. The apparatus of claim 4, wherein said further magnetic means comprise permanent magnets (11) operatively secured to said runner means (3) and ferromagnetic means forming said one edge of said drafting board.

6. The apparatus of claim 1, wherein said rail means (2) comprise a longitudinal slot (48) through which said second journal means extends, whereby said rail means are angularly adjustable relative to said runner means (3) by tilting about the first mentioned journal means.

7. The apparatus of claim 6, wherein said slide means (21, 22) comprise a clamping member (20) for securing the rod (19) and with it the rail means (2) in an angularly adjusted position.

8. The apparatus of claim 1, wherein said carriage means (6) comprise an elongated support member (27) extending in parallel to said rail means (2), said magnetic means comprising a ferromagnetic member forming at least one narrow edge of said rail means, at least two permanent magnets operatively secured to said elongated support member in positions facing said narrow edge (47) of said rail means, roller means operatively secured to said carriage means, said roller means bearing against said narrow edge, said roller means and said permanent magnets being located relative to one another in such a manner that a gap is formed between said permanent magnets and said narrow edge.

9. The apparatus of claim 8, further comprising adjustment means for adjusting the width of said gap.

10. The apparatus of claim 1, further comprising handle means operatively secured to said carriage means, brake means including a brake lever (32) functionally combined with said handle means, and brake shoe means operatively connected to said brake handle means, said brake shoe means being so positioned in said carriage means that said brake shoe means normally bear against said rail means whereby, due to the cooperation of said magnet means and of said brake shoe means, unintentional displacement of said carriage means relative to said rail means is prevented.

11. The apparatus of claim 10, wherein said rail means comprise a narrow edge, said brake shoe means normally bearing against said narrow edge of said rail means.

12. The apparatus of claim 1, wherein said ruler means are secured to said carriage means in a removable manner, said ruler means comprising cutout means in the area between the ruler edges.

13. The apparatus of claim 12, wherein said cutout means comprise edges arranged substantially radially relative to the center of the ruler.

14. The apparatus of claim 13, wherein said edges of said cutout means are angularly spaced from one another to diverge radially outwardly to thereby provide spacings ranging from about 10° to 20°, preferably 15° between adjacent cutout edges.

15. A drafting apparatus for cooperation with a drafting board, comprising rail means (2), adjustable connecting means operatively securing said rail means relative to a drafting board, whereby said rail means are diaplaceable and adjustable into an angular position relative to a centered position in which the rail means extend perpendicularly to an edge of a drafting board, arresting means (20) cooperating with said connecting means for holding said rail means in a fixed adjusted position, said apparatus further comprising carriage means, magnetic means forming part of said carriage means and part of said rail means, whereby said carriage means is adjustably secured to said rail means by said magnetic means, and ruler means operatively secured to said carriage means so that the position of said ruler means is adjustable by moving said carriage means along said rail means, wherein said rail means (2) comprise a narrow edge, said apparatus further comprising brake shoe means normally bearing against said narrow edge of said rail means for normally holding said carriage means stationary, wherein said ruler means are secured to said carriage means in a removable manner, said ruler means comprising cutout means in the area between the ruler edges, said cutout means comprising edges arranged substantially radially relative to the center of the ruler, and wherein said edges of said cutout means are angularly spaced from one another to diverge radially outwardly to thereby provide spacings ranging from about 10° to 20°, preferably 15° between adjacent cutout edges.

16. A drafting apparatus for cooperation with a drafting board, comprising rail means (2), adjustable connecting means operatively securing said rail means relative to a drafting board, whereby said rail means are displaceable and adjustable into an angular position relative to a centered position in which the rail means extend perpendicularly to an edge of a drafting board, arresting means (20) cooperating with said connecting means for holding said rail means in a fixed adjusted position, said apparatus further comprising carriage means, magnetic means forming part of said carriage means and part of said rail means, whereby said carriage means is adjustably secured to said rail means by said magnetic means, and ruler means operatively secured to said carriage means so that the position of said ruler means is adjustable by moving said carriage means along said rail means, said carriage means (6) comprising an elongated support member (27) extending in parallel to said rail means (2), said magnetic means comprising a ferromagnetic member forming at least one narrow edge of said rail means, at least two permanent magnets operatively secured to said elongated support member in positions facing said narrow edge (47) of said rail means (2), roller means operatively secured to said carriage means, said roller means bearing against said narrow edge (47), said roller means and said permanent magnets being located relative to one another in such a manner that a gap is formed between said permanent magnets and said narrow edge, handle means operatively secured to said carriage means, brake means including a brake lever (32) functionally combined with said handle means, and brake shoe means operatively connected to said brake handle means, said brake shoe means being so positioned in said carriage means that said brake shoe means normally bear against said narrow edge (47) of said rail means (2) whereby, due to the cooperation of said magnet means and of said brake shoe means, unintentional displacement of said carriage means relative to said rail means is prevented.

* * * * *